US005711901A

United States Patent [19]

Berg et al.

[11] Patent Number: 5,711,901

[45] Date of Patent: Jan. 27, 1998

[54] CARBURETOR HAVING TEMPERATURE-COMPENSATED PURGE/PRIMER

[75] Inventors: David L. Berg, Auburn; Matthew A. Braun, Caro; Donald C. Ross, Cass City, all of Mich.

[73] Assignee: Walbro Corporation, Cass City, Mich.

[21] Appl. No.: 658,761

[22] Filed: Jun. 5, 1996

[51] Int. Cl.[6] ..... F02M 17/04

[52] U.S. Cl. ..... 261/35; 261/34.3; 261/37; 261/DIG. 8

[58] Field of Search ..... 261/DIG. 8, 34.3, 261/35, 37

[56] References Cited

U.S. PATENT DOCUMENTS

| | | | |
|---|---|---|---|
| 3,313,531 | 4/1967 | Winkley et al. | 261/34.3 |
| 3,739,758 | 6/1973 | Knapp et al. | 261/39.2 |
| 3,767,173 | 10/1973 | Ishii | 261/DIG. 8 |
| 3,913,539 | 10/1975 | Winkley | 261/39.1 |
| 4,271,093 | 6/1981 | Kobayashi | 261/DIG. 8 |
| 4,370,282 | 1/1983 | Yokoyama | 261/34.3 |
| 4,373,479 | 2/1983 | Billingsley et al. | 261/DIG. 8 |
| 4,447,370 | 5/1984 | Kobayashi et al. | 261/DIG. 8 |
| 4,984,542 | 1/1991 | Rische et al. | 261/39.1 |

FOREIGN PATENT DOCUMENTS

| | | | |
|---|---|---|---|
| 0147148 | 6/1989 | Japan | 261/DIG. 8 |
| 0147149 | 6/1989 | Japan | 261/DIG. 8 |

*Primary Examiner*—Tm R. Miles

*Attorney, Agent, or Firm*—Barnes, Kisselle, Raisch, Choate, Whittemore & Hulbert

[57] ABSTRACT

A carburetor for a two or four stroke engine having a diaphragm chamber for supplying fuel to the air intake passage of the engine, and a reservoir for primer fuel. A manually operable pump or bulb draws fuel from the diaphragm chamber into the reservoir. An outlet passage leads from the reservoir to deliver primer fuel to the engine. A normally closed manually operable valve or button is provided for opening the outlet passage. The capacity or the reservoir is varied as a function of ambient temperature by a temperature compensator.

7 Claims, 3 Drawing Sheets

CARBURETOR HAVING TEMPERATURE-COMPENSATED PURGE/PRIMER

FIELD OF THE INVENTION

This invention relates generally to carburetors and more particularly to a carburetor having a purge/primer.

BACKGROUND OF THE INVENTION

Diaphragm carburetors have been in use for many years. One such carburetor is shown and described in U.S. Pat. No. 4,271,093. Diaphragm carburetors in general have a diaphragm chamber from which fuel is metered through main and idling jet orifices into the air intake passage.

In the operating phase of the engine, the diaphragm repeatedly opens and closes an inlet valve so that fuel can enter the diaphragm chamber. Fuel from the diaphragm chamber flows through the jet orifices into the air intake passage depending on the position of a throttle valve in the passage.

When there is insufficient fuel in the diaphragm chamber during the starting phase, for example, or when trying to restart an engine which has run out of fuel, filling the diaphragm chamber with liquid fuel is necessary to start the engine. Completely filling this chamber is sometimes difficult depending upon a variety of conditions.

SUMMARY OF THE INVENTION

The carburetor of this invention has a manually actuable mechanism for purging and completely filling the diaphragm chamber with liquid fuel and priming the engine for starting by discharging a quantity of liquid fuel. Preferably, the quantity of primer fuel is varied according to the outside temperature. More specifically, the carburetor is provided with a purge/primer having a chamber or reservoir for primer fuel to facilitate engine starting, with a temperature-compensator for varying the volume of the reservoir as a function of ambient temperature. Accordingly, the volume of this reservoir or chamber will be increased to hold more starting fuel when operating in a low temperature environment, and will be decreased at higher ambient temperatures where less starting fuel is required.

The carburetor of this invention preferably has a manually operable pump for drawing fuel, preferably from the diaphragm chamber, into the starting fuel reservoir. When full, the fuel in the reservoir can be discharged to prime the engine, by directing the starting fuel into the engine crankcase, or the air intake passage.

The temperature-compensator may, for example, employ thermostatic wax, silicone, or other thermally active, temperature sensitive materials in actuating devices, or temperature sensitive metals or bimetals formed in the shape of discs, springs, beams, etc.

It is an object of this invention to provide a carburetor with a temperature-compensated purge/primer having the foregoing features and capabilities.

Another object is to provide a carburetor with a temperature-compensated purge/primer which is composed of a relatively few simple parts, is rugged and durable in use, and is capable of ready and inexpensive manufacture and assembly.

BRIEF DESCRIPTION OF THE DRAWINGS

These and other objects, features and advantages of the invention will become more apparent as the following description proceeds of the presently preferred embodiment and the best mode, especially when considered with the accompanying drawings, wherein:

FIG. 12 is a sectional view of the purge/primer of

FIG. 10 showing the parts in a different position.

DETAILED DESCRIPTION

Figure 1:
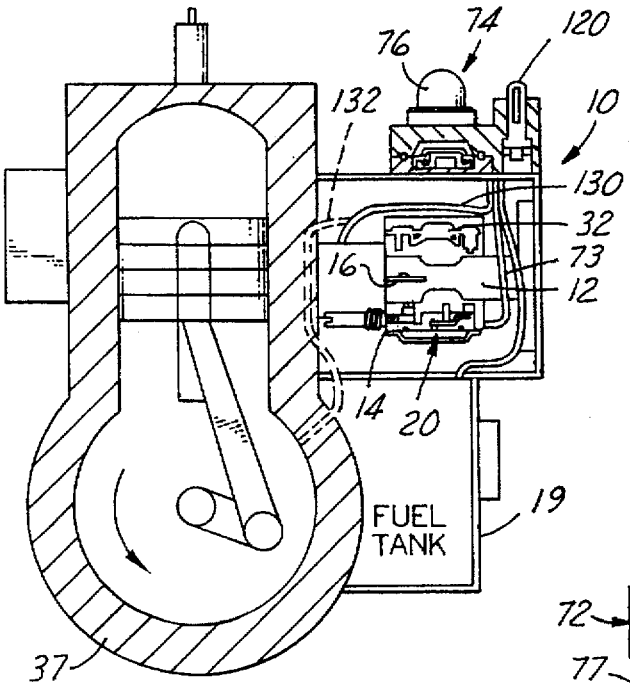
FIG. 1 is a semi-diagrammatic view partly in section showing a carburetor constructed in accordance with this invention, mounted on an engine.
Figure 3:
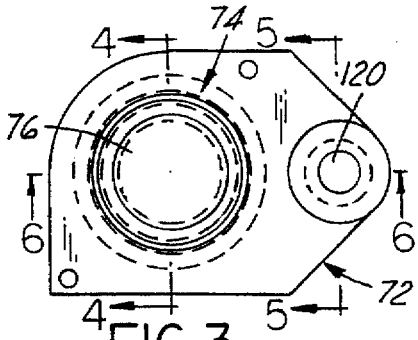
FIG. 3 is a top view of the purge/primer device forming a part of the carburetor.
Figure 4:
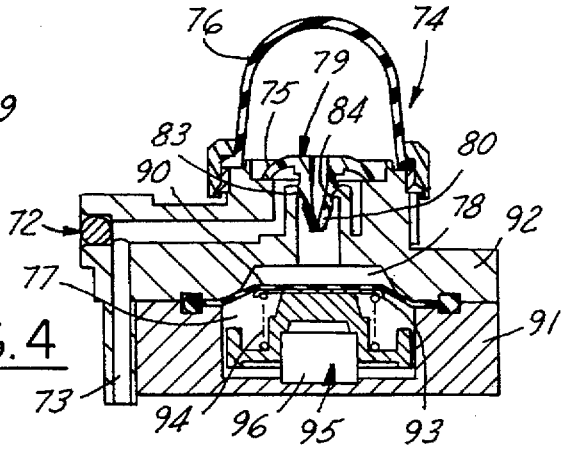
FIG. 4 is a sectional view of the purge/primer device taken generally on line 4—4 of FIG. 3.
Figure 2:
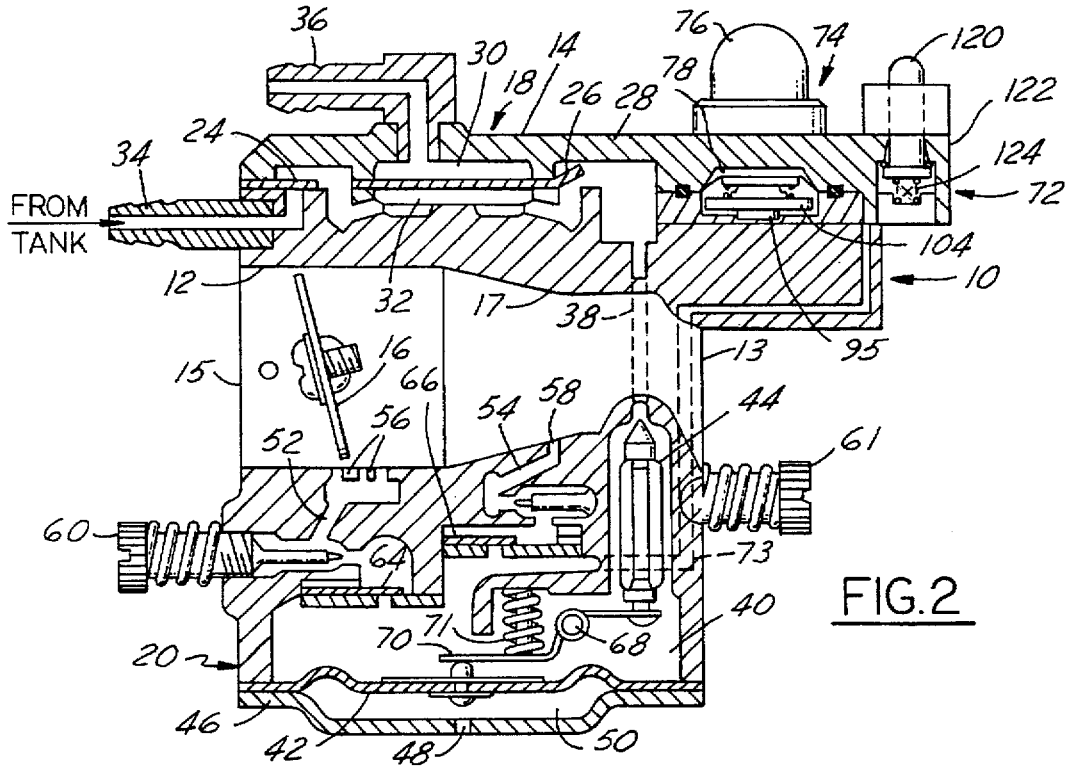
FIG. 2 is an enlarged sectional view of the carburetor.
Figure 5:
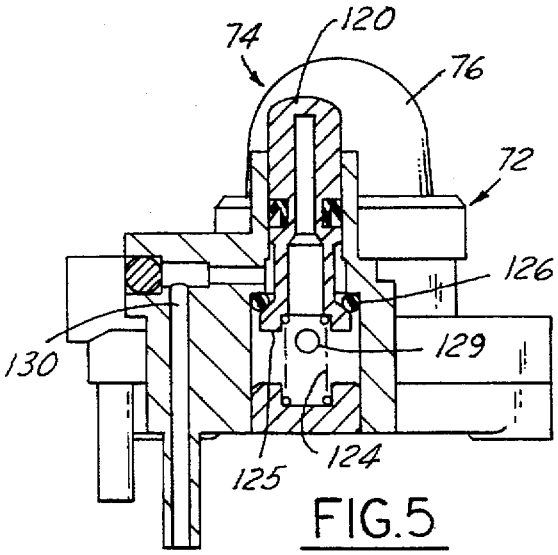
FIG. 5 is a sectional view of the purge/primer device taken generally on line 5—5 of FIG. 3.

Referring more particularly to the drawings, and especially FIGS. 1–7, the carburetor 10 (FIG. 2) includes a carburetor body 14 which has an air passage 12 controlled by a throttle valve 16. The entrance end 13 of the air passage 12 provides a suitably filtered air inlet for the carburetor. The other end 15 of the air passage 12 leads to the fuel and air mixture inlet of an internal combustion engine on which the carburetor is mounted. The air passage 12 has a venturi portion 17 of standard construction.

A fuel supply pump 18 at the top of the carburetor body operates to supply fuel from the fuel tank 19. A pressure control mechanism 20, which is generally a diaphragm-controlled chamber, controls the flow of fuel at a constant pressure from the pump to the main fuel jet and idle jets to be described more fully hereinafter.

The fuel pump 18 is a diaphragm pump of standard known construction provided with a diaphragm 22 and inlet and outlet check valves 24 and 26. The diaphragm 22 is clamped between the carburetor body 14 and a cover plate 28 secured to the carburetor body. There is an actuating chamber 30 on the cover side of the diaphragm 22 and a pumping chamber 32 on the carburetor body side. The pumping chamber 32 is connected with the fuel tank 19 by a tubular connection 34. The pump is actuated by pressure pulses, namely, engine crankcase pressure pulses, which are transmitted to the chamber 30 through a tubular connection 36 mounted on the cover 28. In a two-cycle engine, for example, the connection 36 will be connected to the crankcase 37 of the engine to conduct pulses from the crankcase to the chamber 30.

With the engine running, the pump 18 will bring fuel through the inlet check valve 24 to the pumping chamber 32 and out of the outlet cheek valve 26 leading to a fuel well having a flow passage 38 connected to a valve seat controlled by an inlet valve 44.

The carburetor diaphragm chamber mechanism 20 comprises a main diaphragm 42 that forms a fuel chamber 40 which receives fuel from the pump 18 through the passage 38 and a fuel inlet valve 44. The inlet valve 44 operates intermittently to open and close the valve seat at the bottom end of the passage 38. The diaphragm 42 is clamped peripherally between the lower portion of the carburetor body 14 and the closing cover 46 secured to the carburetor body. A chamber 50 is formed below the diaphragm 42 and is open to the atmosphere through an opening 48 on the cover 46.

The diaphragm chamber 40, which is the fuel supply chamber, is open to the fuel and air mixture passage 12 through two supply passages 52 and 54. The fuel supply passage 52 opens to the air passage 12 through a plurality of idle jets 56 adjacent to the throttle valve 16. The fuel supply passage 54 opens to the air passage 12 through the main jet 58. The adjustment of the fuel jets can be regulated by adjustment needle valves 60 and 61. Check valves 64 and 66 are provided for the fuel supply openings to prevent air from backbleeding into the chamber 40. When the purge/primer, to be described later, is actuated, the check valve 66 functions to block air from reaching the diaphragm chamber 40 through the main jet 58, and similarly, the check valve 64 will block the flow of air from the air passage 12 into the diaphragm chamber 40.

In the diaphragm chamber 40, there is a mounting pin 68 that mounts a lever 70 which has one end bearing against a central portion of the diaphragm 42 and the other end connected to the bottom of the fuel inlet valve 44. Consequently, during normal operation of the engine when a strong suction pulse is transmitted from air passage 12, fuel flows through the ports 52 and 54 from the diaphragm chamber 40, there is a tendency to raise the diaphragm 42, open valve 44, and cause fuel to flow from passage 38 into the diaphragm chamber 40 from the fuel supply pump 18. When this suction pulse is relieved, by flow of fuel into the diaphragm chamber 40, the inlet valve 44 has a tendency to move toward its closed position. The coil spring 71 bearing against the lever 70 also tends to move the inlet valve 44 to closed position.

Thus, when the internal combustion engine is running, the diaphragm chamber 40 functions as a pressure regulator which receives a certain amount of sub-atmospheric pressure in pulses from the engine and serves to maintain a substantially constant fuel pressure in the diaphragm chamber 40. Thus, the fuel supply jets will deliver the proper amount of fuel to the air passage 12 depending on the position of the throttle 16.

PURGE/PRIMER

When the engine is not running and therefore the pump 18 is not receiving engine pulses, it is sometimes difficult to start the engine particularly in cold weather or when the fuel tank is empty and there is no fuel or insufficient fuel in the diaphragm chamber 40. Under those circumstances, a purge/primer system is needed for starting the engine.

A purge/primer 72 is connected to the diaphragm chamber 40 by a passage 73. The passage 73 leads to a suction pump 74 formed by a domed cap or bulb 76 of a flexible and resilient material such as rubber. Fuel may be drawn into and from the diaphragm chamber 40 by repeatedly squeezing or pressing and releasing the bulb. This action also purges the diaphragm chamber 40 and the pump 18 of air. The suction produced by the bulb unseats the lip 75 of a valve body 79 so that the fuel drawn up into the passage 73 can enter the bulb 76. The valve body 79 has a stem 82 received in a counterbore 83 and retained therein by an integral annular ring 84. The valve body 79 also has a "duckbill" outlet valve with two opposed flaps 85 formed by a narrow slit or passage 86 through the stem 82. This check valve could be a spring-loaded ball or disc or any other type of check valve, instead of a duckbill check valve. The flaps 85 are normally closed or sealed together and open when superatmospheric pressure is produced by bulb 76 when it is squeezed or depressed which discharged fluid from the bulb into the passageway 80 and the primer reservoir 78.

While preferably primer fuel is drawn into the reservoir 78 from the diaphragm chamber 40, as shown, it may, if desired, be drawn from the fuel tank 19.

The reservoir 78 becomes full of fuel after the bulb 76 has been squeezed several times. The fuel in the reservoir is held under a predetermined pressure by a check valve 88 (FIG. 6) and also by the valve 86. The valve 88 maintains the pressure in the reservoir 78 at any desired pressure, for example, between 1 and 20 psi. The valve 88 in this instance is a spring-loaded ball 89, but may be a disc or duck bill or any other type of check valve. If the bulb 76 is squeezed more times than necessary to fill the reservoir 78, the excess fuel is returned to the fuel tank 19 through passage 85 past check valve 88.

Figure 6:
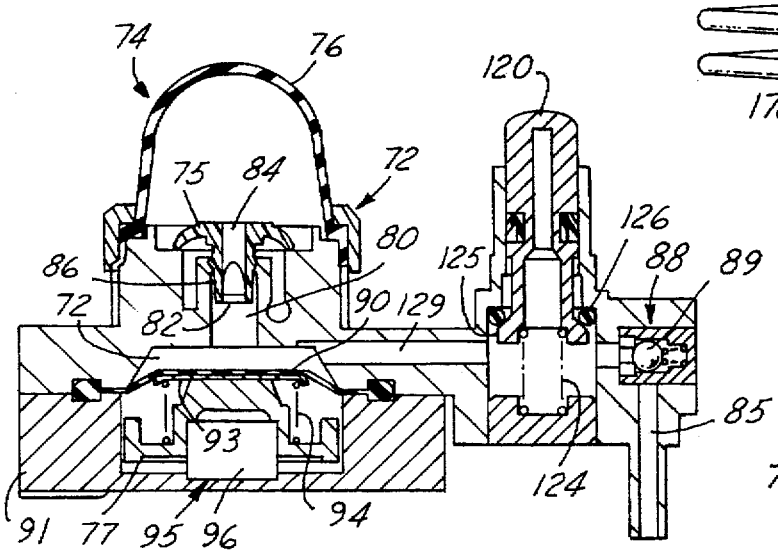
FIG. 6 is a sectional view of the purge/primer device taken generally on line 6—6 of FIG. 3.
Figure 6A:
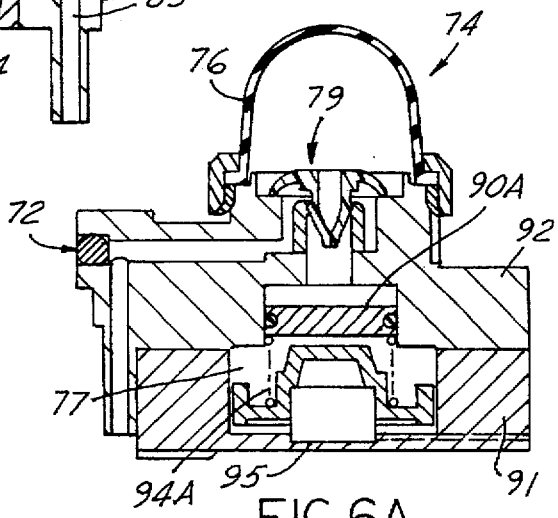
FIG. 6A is similar to FIG. 6 but shows a modification.

The reservoir 78 is a receptacle for primer fuel and is formed in a cavity 77 in the body of the carburetor above a spring-loaded diaphragm 90. The diaphragm 90 is clamped between carburetor body parts 91 and 92. A pressure unit comprises a diaphragm-supporting plate 93 beneath the diaphragm 90 which is pressed upwardly against the diaphragm by a spring 94, to maintain the fuel in the reservoir under pressure. The pressure of the fuel in the reservoir holds the spring-loaded diaphragm down. The spring 94 and diaphragm 90 and supporting plate 93, could, if desired, be replaced by a spring-loaded piston or other device suitable for the purpose. FIG. 6A shows this modification in which the piston is designated 90A and the spring for loading the piston is designated 94A.

Figure 7:
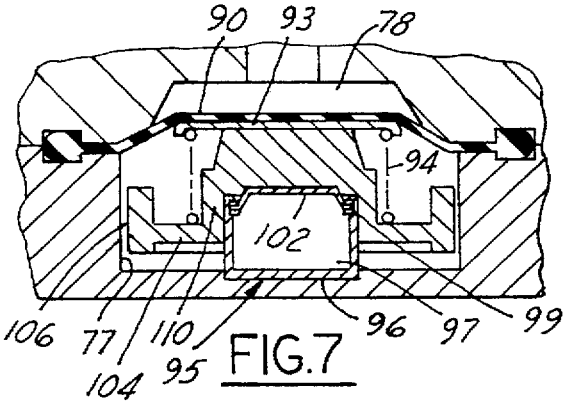
FIG. 7 is an enlarged fragmentary sectional view of the purge/primer.

The volume of the reservoir 78 when full is determined by a temperature-compensating device 95. This device comprises a cup 96 secured to the lower body part 91 at the bottom of the cavity 77 beneath the diaphragm 90. The cup contains a mass of temperature-sensitive material 97, in this instance thermostatic wax or silicone (FIG. 7). The wax expands and contracts as the ambient temperature increases and decreases. The cup 96 has a cylindrical side wall and is open at the top. An inner annular groove 99 beneath the top of the cup receives a pair of rings 100 between which is clamped the periphery of a flexible, resilient cover sheet 102 which is stretched across the top of the cup to confine the wax. The cover sheet 102 stretches as necessary when the wax 97 expands due to an increase in temperature and presses the wax back into the cup 96 when the temperature drops.

A piston-like spring seat 104 is vertically slidable in the cavity 77 beneath the diaphragm 90. The spring seat 104 is supported on the cover sheet 102 of the temperature compensating device 95. The spring seat 104 has an annular peripheral flange 106 slidably engaging the cylindrical side wall of the cavity 77, and a hollow central portion 110 which fits over and slides on the side wall of the cup 96. The spring 94 is compressed between the spring seat 104 and the diaphragm-supporting plate 93. The spring 94 forces the plate 93 upwardly against the diaphragm 90 to cause the diaphragm to assume a position near the top wall of the cavity when the primer chamber is empty. The spring seat 104 provides a vertically adjustable base for the spring 94 to determine the volume of the primer reservoir when full. The ambient temperature causes the wax in the cup 96 to expand or contract and thus adjusts the vertical position of the spring seat 104 and hence the maximum volume of the reservoir 78.

The rings 100 form an opening through which the expanding wax 97 extrudes upwardly in a vertical column in response to an increase in temperature. The rings 100 are of smaller diameter than the side wall of the cup 96 to increase the vertical travel of the wax.

A manual release button 120 of a valve 121 is provided for releasing the fuel held in the reservoir when it is desired to prime the engine. The release button 120 is an elongated piston-like member supported for longitudinal sliding movement in a housing extension 122 of the carburetor. Normally, the button is held in the closed position of the valve 121 by a spring 124 so that the annular valve flange or head 125 at the bottom of the piston seals against an O-ring seal 126 in the housing extension and thereby retains the fuel in the reservoir. However, when the button is depressed, the passage 129 from the reservoir communicates through the valve 121 with the passage 130 leading from the button. The pressure of the spring 94 against diaphragm 90 forces the diaphragm upwardly to expel the fuel from the reservoir 78 and out through passages 129 and 130. Passage 130 extends to the air passage 12 to prime the engine. Alternatively, in a two-stroke engine, the passage 130 may lead to the engine crankcase 37 through passage 132 as shown in dotted lines in FIG. 1.

In use, when it is desired to prime the engine, the bulb 76 is squeezed perhaps 5 or 6 times to draw fuel into the primer reservoir 78. The amount of fuel drawn into the reservoir depends on the temperature compensating device 95. In cold weather, the spring seat 104 is lowered by contraction of the wax 97, so that the maximum volume of the reservoir is increased. Thereafter, the button 120 of valve 121 is depressed, allowing primer fuel to be expelled from the reservoir by the force of spring 94. The expelled primer fuel flows through passages 129 and 130 either to the air intake passage 12 or the engine crankcase 37.

Figure 9:
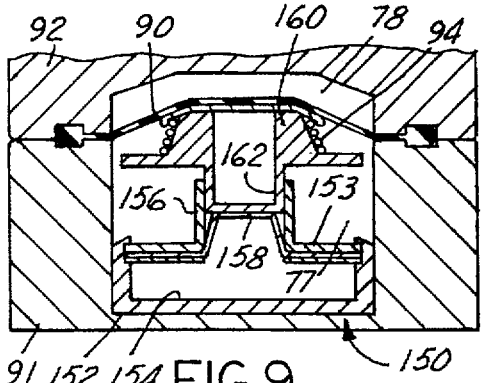
FIG. 9 is a sectional view similar to FIG. 8, but showing the parts in a different position.
Figure 8:
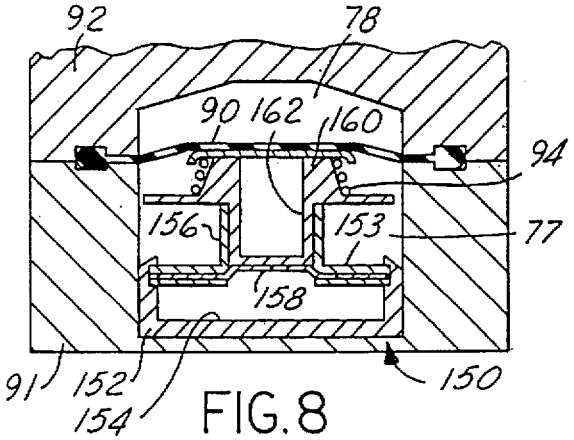
FIG. 8 is a sectional view of a portion of a purge/primer of modified construction.

FIGS. 8 and 9 show a modification of the invention in which the temperature-compensating device 150 comprises a cup 152 secured to the bottom of body part 91 in the cavity 77. A cap 153 is secured to and closes the top of the cup to define a chamber 154 for thermal wax 155. The cup 152 has a central upwardly extending tubular portion 156. A flexible cover sheet 158 extends across the tubular portion 156 within the cup 152 to confine the wax. When the wax expands, it forces the cover sheet 158 upwardly into the tubular portion 156 as shown in FIG. 9.

The spring seat 160 has a central downwardly extending stem 162 which is slidable within the tubular portion 156 of cap 153. The bottom of stem 162 normally rests upon the cover sheet 158. In the fully contracted condition of the wax in relatively cold climatic conditions as seen in FIG. 8, the spring seat 160 rests upon the upper rim of the tubular portion 156 of cup 152. The coil spring 94 is compressed between the seat 160 and the diaphragm-supporting plate 93. Expansion of the wax due to an increase in temperature causes the cover sheet 158 to project upwardly into the tubular portion 156, elevating the spring seat 160. This modification functions in the same manner as the first embodiment although differing structurally.

Figure 11:
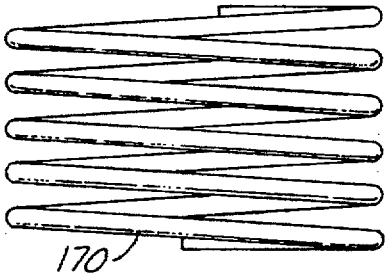
FIG. 11 is an enlarged view of a bimetal spring of the purge/primer of FIG. 10.
Figure 10:
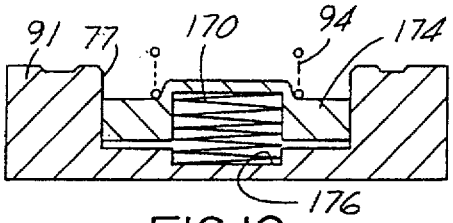
FIG. 10 is a sectional view of a purge/primer of modified construction.
Figure 12:
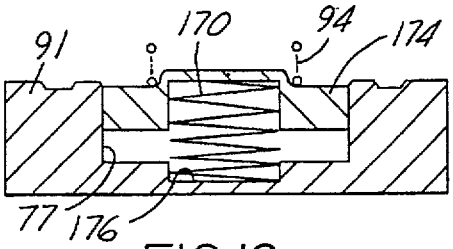

FIGS. 10–12 illustrate a modified temperature compensation device 168 with a compression type bimetal coil spring 170. The bimetal spring 170 elongates in response to an increase in temperature and shortens in response to a decrease in temperature. The bimetal spring may, for example, consist of the metallurgically bonded metals copper and stainless steel, or nickel-titanium alloys. The lower body part 91 supports within the cavity 77 a vertically slidable spring seat 174. The bimetal spring 170 is disposed in a recess 176 in the bottom of the cavity 77 and extends upwardly into a recess in the spring seat 174. The spring seat 174 supports the spring 94 as in the first embodiment, which is compressed against the diaphragm-supporting plate 93 (not shown). FIG. 10 shows the position of the spring seat 174 when the bimetal spring 170 is relatively cold. FIG. 12 shows the position of the spring seat 174 after the bimetal spring 170 has expanded due to an increase in the ambient temperature.

Figure 13:
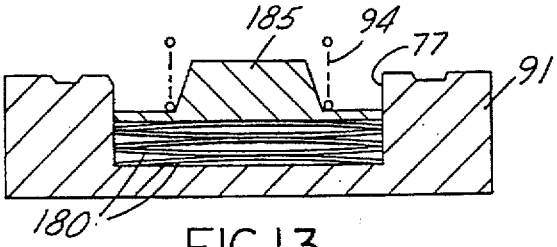
FIG. 13 is a sectional view of a purge/primer of modified construction.
Figure 14:
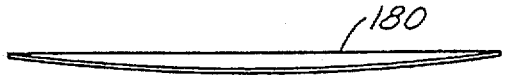
FIG. 14 is an enlarged view of a bimetal disc of the purge/primer of FIG. 13.
Figure 15:
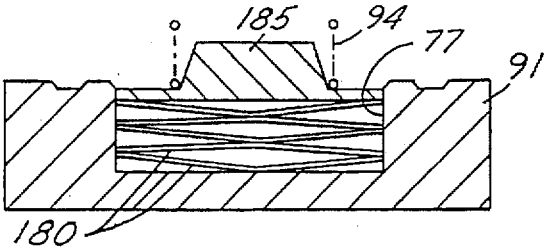
FIG. 15 is a sectional view of the purge/primer of FIG. 13 showing the parts in a different position.

FIGS. 13–15 illustrate a modified temperature compensation device 178 with a plurality of bimetal discs 180 which are slightly dished. The discs 180 are flexible and resilient and tend to become more deeply dished in response to an increase in temperature. The bimetal discs may consist of the metals copper and stainless steel. The discs are stacked alternately in opposed relation in the bottom of the cavity 77 in the body part 91, that is, with every other disc inverted so that there is no nesting of the discs. The discs are stacked in pairs with the peripheral edges of each pair in contact and with the convex central bottom portions of each pair in contact. FIG. 13 shows the position of the spring seat 185 when supported on a stack of the bimetal discs 180 in relatively cold conditions, and FIG. 15 shows the more elevated position of the spring seat 185 after the discs have become more deeply dished due to an increase in the temperature.

Figure 16:
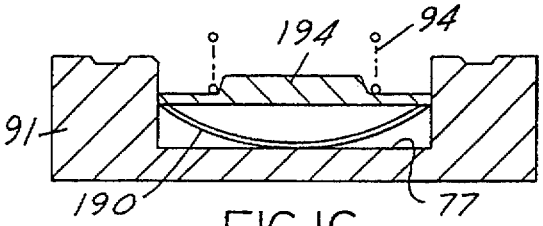
FIG. 16 is a sectional view of another purge/primer of modified construction.
Figure 17:
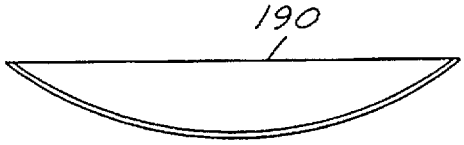
FIG. 17 is an enlarged view of a bimetal disc of the purge/primer of FIG. 16.
Figure 18:
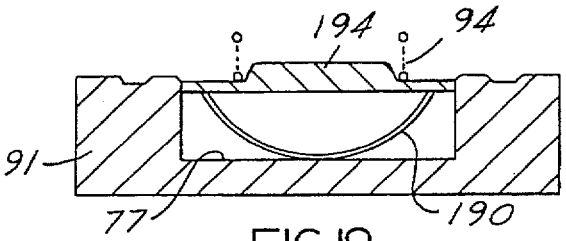
FIG. 18 is a sectional view of the purge/primer of FIG. 16 showing the parts in a different position.

FIGS. 16–18 illustrate a modified temperature compensation device 188 with a bimetal disc 190 which is similar to the disc 180 and may be of the same material, but of a more deeply dished configuration. As shown in FIGS. 16 and 18, only one disc of this configuration is needed as the temperature-compensating member. FIG. 16 shows the spring seat 194 supported on the disc 190 in relatively cold conditions, and FIG. 18 shows the same spring seat supported at a higher level by the disc 190 which has become more deeply dished in response to an increase in the temperature.

The discs 180 as well as the disc 190 support the spring seats as in the first embodiment, which supports spring 94 compressed against the diaphragm-supporting plate 93 (not shown). The spring 170 and the discs 180 and 190, instead of being bimetal, may be made of a metal memory alloy such, for example, as nickel-titanium alloy.

The carburetor of this invention is adapted particularly for use with 2 or 4 stroke engines particularly of the type used in lawn mowers, chain saws, hedge and edge trimmers, weed cutters and the like.

What is claimed is:

1. A carburetor for an engine, the carburetor comprising a body having an air intake passage to the engine, a fluid supply port, a diaphragm chamber communicating with said fuel supply port for supplying fuel to the air intake passage, a cavity in the body, a movable partition extending across the cavity and dividing the cavity into a reservoir of variable volume for primer fuel at one side of the partition and a compartment at the other side thereof, a manually-operable pump for drawing fuel from said diaphragm chamber into said reservoir, an outlet passage leading from said reservoir to deliver primer fuel to the engine, a normally closed manually-operable valve for opening said outlet passage, means for varying the volume of said reservoir as a function of ambient temperature comprising a temperature compensator mounted in said compartment, a spring seat slidably guided in said compartment for movement toward and away from the partition and beating on said temperature compensator, and a spring compressed between said partition and said seat.

2. A carburetor as defined in claim 1, wherein said partition is a piston.

3. A carburetor as defined in claim 1, wherein said partition is a flexible diaphragm, and a diaphragm supporting plate between said spring and said diaphragm.

4. A carburetor as defined in claim 1, wherein said temperature compensator comprises a cup containing a temperature sensitive thermal expansion material and having an open end opposed to said spring seat, a flexible cover sheet closing the open end of said cup, said spring seat having recess in which the open end of said cup is slidably engaged, and said recess having a base engaging said cover sheet.

5. A carburetor as defined in claim 4, wherein the open end of said cup is defined by a tubular extension opposed to said spring seat, and said spring seat has a stem slidably engaged in the tubular extension of said cup.

6. A carburetor as defined in claim 1, wherein said thermal expansion material comprises thermoplastic wax or silicone.

7. A carburetor as defined in claim 6, wherein said compartment has an annular wall and said spring seat is slidably guided by said annular wall.

* * * * *

UNITED STATES PATENT AND TRADEMARK OFFICE

CERTIFICATE OF CORRECTION

PATENT NO. : 5,711,901

DATED : January 27, 1998

INVENTOR(S) : David L. Berg/Matthew A. Braun/Donald C. Ross

It is certified that error appears in the above-indentified patent and that said Letters Patent is hereby corrected as shown below:

Col 7, Line 21, change "beating" to "bearing".

Signed and Sealed this

FourthDay of August, 1998

Bruce Lehman

*Attest:*

BRUCE LEHMAN

*Attesting Officer*

*Commissioner of Patents and Trademarks*